US011292628B2

(12) United States Patent
Badini et al.

(10) Patent No.: US 11,292,628 B2
(45) Date of Patent: Apr. 5, 2022

(54) MACHINE FOR FORMING FILTER BAGS FOR INFUSION PRODUCTS

(71) Applicant: I.M.A. INDUSTRIA MACCHINE AUTOMATICHE S.p.A., Ozzano Del'Emilia (IT)

(72) Inventors: Simone Badini, Ozzano Del'Emilia (IT); Sauro Rivola, Ozzano Del'Emilia (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 441 days.

(21) Appl. No.: 16/486,966

(22) PCT Filed: Mar. 6, 2018

(86) PCT No.: PCT/IB2018/051436
§ 371 (c)(1),
(2) Date: Aug. 19, 2019

(87) PCT Pub. No.: WO2018/167604
PCT Pub. Date: Sep. 20, 2018

(65) Prior Publication Data

US 2019/0375524 A1 Dec. 12, 2019

(30) Foreign Application Priority Data

Mar. 17, 2017 (IT) ..... 102017000029640

(51) Int. Cl.
*B65B 29/02* (2006.01)
*B65B 1/02* (2006.01)
(Continued)

(52) U.S. Cl.
CPC ..... *B65B 29/028* (2017.08); *B65B 1/02* (2013.01); *B65B 29/04* (2013.01); *B65B 43/50* (2013.01)

(58) Field of Classification Search
None
See application file for complete search history.

(56) References Cited

U.S. PATENT DOCUMENTS 3,774,369 A * 11/1973 Klar ..... B65B 29/04 53/134.2
3,805,483 A * 4/1974 Romagnoli ..... B65B 29/04 53/134.2

(Continued)

FOREIGN PATENT DOCUMENTS

CN 1071673 C 9/2001
CN 1692057 A 11/2005

(Continued)

OTHER PUBLICATIONS

International Search Report and Written Opinion dated May 4, 2018 for counterpart International Patent Application No. PCT/IB2018/051436.

(Continued)

*Primary Examiner* — Hemant Desai
*Assistant Examiner* — Tanzim Imam
(74) *Attorney, Agent, or Firm* — Shuttleworth & Ingersoll, PLC; Timothy Klima

(57) ABSTRACT

A machine for forming filter bags for infusion products starting from pieces of filter material each containing a dose of infusion product and having, the pieces, a corresponding longitudinal axis of extension, including a carousel rotating about a main axis of rotation and including gripping elements movable in rotation about the main axis along a closed circular trajectory; each gripping element configured to receive and retain a piece of filter material along an oper- (Continued)

ating path; an operating station configured to perform an operation on the piece of filter material retained by a corresponding gripping element; each gripping element including an articulation device configured for obtaining a further rotation about a secondary axis of rotation, transversal to the main axis of rotation, to rotate and position the corresponding piece of filter material with its longitudinal axis of extension parallel to the main axis of rotation at the operating station.

20 Claims, 9 Drawing Sheets

(51) Int. Cl.
*B65B 29/04* (2006.01)
*B65B 43/50* (2006.01)

(56) References Cited

U.S. PATENT DOCUMENTS 5,870,880 A * 2/1999 Romagnoli ..... B65B 29/04 53/134.2
5,893,256 A * 4/1999 Ghirlandi ..... B65B 29/04 53/134.2
6,948,292 B2 * 9/2005 Romagnoli ..... B65B 29/028 53/134.2
2007/0212255 A1 * 9/2007 Brombin ..... B67C 7/0073 422/27
2009/0241468 A1 * 10/2009 Bernardi ..... B65B 35/20 53/77
2015/0217883 A1 * 8/2015 Rea ..... B65B 7/162 53/281
2015/0284122 A1 * 10/2015 Murray ..... B65B 43/60 248/99

FOREIGN PATENT DOCUMENTS

CN 1297453 C 1/2007
CN 102036880 A 4/2011
EP 0762974 B1 11/1999
EP 0765274 B1 3/2000
EP 0762973 B1 7/2000
EP 1384665 A1 1/2004
KR 20120056685 A 6/2012

OTHER PUBLICATIONS

Chinese Office Action dated Sep. 27, 2020 from counterpart Chinese Patent Application No. 201880018502.3.

* cited by examiner

MACHINE FOR FORMING FILTER BAGS FOR INFUSION PRODUCTS

This application is the National Phase of International Application PCT/IB2018/051436 filed Mar. 6, 2018 which designated the U.S.

This application claims priority to Italian Patent Application No. 102017000029640 filed Mar. 17, 2017, which application is incorporated by reference herein.

TECHNICAL FIELD

This invention relates to a machine for forming filter bags for infusion products, such as tea, coffee, camomile (in powder, granular or leaf form).

BACKGROUND ART

The term filter bags is used to indicate at least two types of filter bag: the single-chamber filter bags, comprising, in a minimum configuration, a piece of filter material forming a chamber containing a dose of infusion product; and the double-chamber filter bags, again comprising a single piece of filter paper, but forming two separate chambers. Each chamber contains a dose of infusion product. The two chambers are folded towards each other forming a single upper end (in the shape of an upturned "V") and a bottom end in the shape of a "W".

The single-chamber and double-chamber filter bags can also be equipped with a tag and a tie string connecting the tag to the filter bag.

Lastly, an overwrap envelope may be added to the above mentioned filter bags for wrapping and closing the single filter bag, in a hermetic or non-hermetic manner.

A type of machine, used for making filter bags of the type called two-lobed, is known from patent documents EP762973, EP762974 and EP765274 (all in the name of the same Applicant).

The machine extends along a forming and feeding line on which are positioned:

- a station for feeding a web of filter paper along a feed surface;
- a station for feeding doses of product on the web of filter paper at predetermined distances;
- a tabularisation station for folding the strip on itself, wrapping the doses of product and, subsequently, longitudinally joining the strip;
- a station for folding individual pieces of filter paper with double chamber;
- a carousel, equipped with radially protruding grippers, positioned beneath the folding station and configured to receive individual pieces of folded filter paper; the carousel, moved stepwise about a horizontal axis, rotates each piece of filter paper to the operating stations, arranged one after another and stationary relative to a frame of the machine, to associate to the piece of filter paper a string, suitably wrapped around the piece of filter paper, and a tag in turn connected to the string.

A further machine of this type is described in patent document EP 1 384 665 which also describes a carousel rotating in a stepwise fashion about an axis. The carousel has a plurality of grippers positioned along the carousel to receive and retain a corresponding piece of folded filter paper. The machine comprises at least one operating station configured for implementing an operation on each piece of filter paper held by a gripper during its circular path actuated by the carousel.

In some machine solutions, depending on the type of filter bag to be formed, there may be (alternatively):

- a station for folding the open ends of the two chambers of the piece along the path of the carousel with their retaining by the knotting of the string on the same piece; or
- a further station for transversal closing of the ends of the piece before or at the same time as the separation from the remaining film.

The machine may also comprise a station for applying a sheet of overwrapping material for each filter bag positioned along the path of the carousel, or at a further carousel.

The machine structured as described above operates intermittently, that is to say, stepwise for all the stations present along the feed line.

The stepwise operation places a limit on the productivity of the machine.

DISCLOSURE OF THE INVENTION

The aim of this invention is to provide a machine for forming filter bags for infusion products with a productivity greater than the productivity of the prior art machines, maintaining a high quality of the filter bag.

More specifically, the aim of this invention to provide a machine for forming filter bags for infusion products with reduced dimensions and high flexibility.

These aims are fully achieved by a machine for forming filter bags for infusion products according to claim 1.

BRIEF DESCRIPTION OF THE DRAWINGS

The invention will be described with reference to the accompanying drawings, provided by way of example only and without limiting the scope of the invention, in which.

DETAILED DESCRIPTION OF PREFERRED EMBODIMENTS OF THE INVENTION

Figure 1:
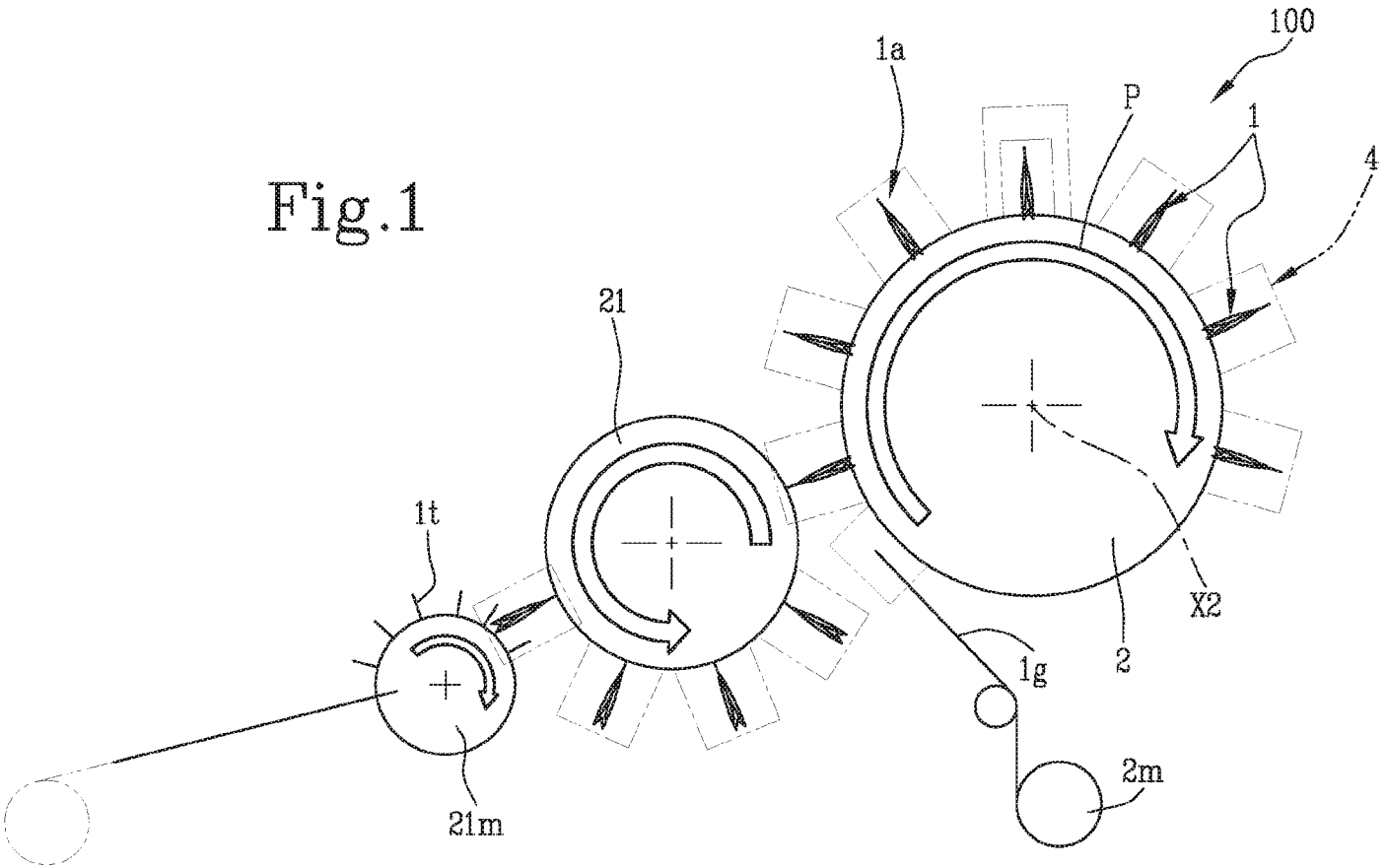
FIG. 1 is a schematic front view, with some parts cut away to better illustrate others, of a machine for forming filter bags containing infusion products according to this invention.
Figure 2:
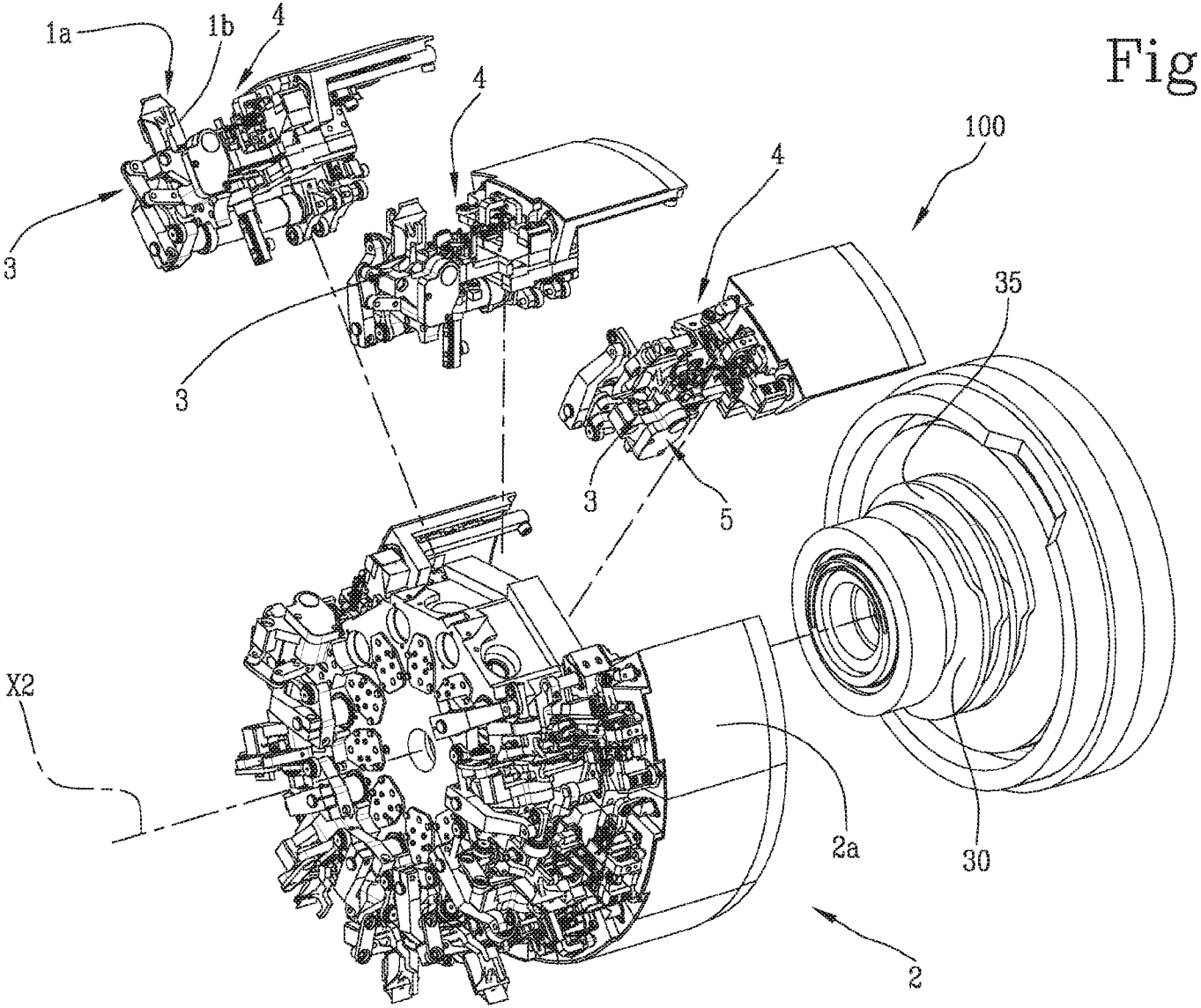
FIG. 2 illustrates a partly exploded perspective view of the machine for forming filter bags containing infusion products, according to this invention, comprising a carousel and a plurality of stations.

A machine according to the invention, labelled 100 in its entirety, is used for making filter bags 1 containing infusion products, such as tea, coffee, camomile dosed in powder, granular or leaf form.

The expression "filter bags" is used to indicate at least two types of filter bag.

A first type, known as single-chamber, comprises a piece of filter material forming a single chamber containing a dose of infusion product.

A second type of filter bag, known as double-chamber, comprises a single piece 1*a* of filter material, which forms two separate chambers 1*b*, 1*c*. Each chamber 1*b*, 1*c* contains a dose of infusion product. The two chambers 1*b*, 1*c* are folded towards each other forming a single upper end (in the shape of an upturned "V") and a bottom end in the shape of a "W".

These two types of filter bag may be equipped with a gripping tag 1*t* and a tie string 1*g* connecting the tag 1*t* to the filter bag 1 formed (see FIGS. 3 to 6).

An outer overwrapping envelope may also be added to wrap around and enclose each single filter bag 1 formed.

The machine structure which will be described and protected in this specification has technical solutions which can be used both for machines with step-mode or discontinuous operation and for machines operating continuously, without therefore limiting this solution to one or other type of machine.

For a greater simplification of the description, this solution will describe a machine with continuous operation, but without thereby limiting the scope of protection of this invention.

The machine 100, according to the invention, starts from the concept of being able to obtain various types of filter bag, including those mentioned above (from the simpler single-chamber filter bag to the more complex double-chamber bag with tie string and tag in overwrap envelope) adding, when necessary, operating stations designed to perform the requested operation on the piece of filter material or on the filter bag.

This specification describes a machine which is capable of applying the string 1*g* between the tag 1*t* and the piece of filter material 1, with, in this case, a continuous operation of the machine.

As already mentioned, irrespective of the type of filter bag to be formed, the part of the piece 1 of filter material containing at least a dose of infusion product.

Each piece 1 has a corresponding longitudinal axis X1 of extension (that is, the axis of longest extension of the piece).

The machine 100 comprises a carousel 2 rotating about a main axis X2 of rotation and equipped with a plurality of movable gripping elements 3 rotating about the main axis X2 of rotation along a closed circular trajectory.

Each gripping element 3 is configured to receive and retain a piece 1 of filter material along an operating path P (in this case circular).

The machine 100 comprises at least one operating station 4 configured to perform an operation on the piece 1 of filter material retained by a corresponding gripping element 3 along the operating path P inside the closed circular trajectory.

As illustrated (FIGS. 3 to 8), each gripping element 3 is provided with articulation means 5 configured for obtaining a further rotation about at least a secondary axis X5 of rotation, transversal to the main axis X2 of rotation, to rotate and position the corresponding piece 1 of filter material with its longitudinal axis X1 of extension parallel to the main axis X2 of rotation at least at the operating station 4.

In other words, the gripping elements are designed to receive the piece of filter material (from other carousels or devices for formation/transit of the piece) along radial trajectories relative to the axis of rotation of the carousel and then rotate the piece in such a way as to bring the piece parallel to the axis of rotation and in the direction of the operating station for the formation operations.

This structure of the gripping elements may be used, as mentioned above, both on carousels moved in a stepwise or discontinuous fashion and with carousels moved continuously.

As illustrated, the machine 100 is structured in such a way that it comprises the movement carousel 2 rotating continuously about the main axis X2 of rotation.

The machine 100 also comprises the plurality of first gripping elements 3 positioned along, and movable continuously with, the movement carousel 2.

The machine 100 also comprises a plurality of first operating stations 4 positioned along, and movable continuously with, the movement carousel 2.

Each operating station 4 is linked to a corresponding gripping element 3 and is configured to perform at least one operation on the piece 1 of filter material along at least one stretch of the operating path P in the closed circular trajectory of the movement carousel 2.

In short, the machine 100 comprises a multiplicity of operating units, all operating a same operation on the piece of filtering material, all independent of each other and driven continuously about an axis of rotation.

Moreover, at the infeed area of the movement carousel 2 (for example a further carousel or a conveying device 21 of the pieces of filter material, as shown in FIG. 1), at which the piece 1*a* is released to a corresponding gripping element 3, the operating station 4 and the corresponding first gripping element 3 are offset horizontally, that is, positioned on different vertical planes, in such a way as to allow the piece 1 to be picked up without interference from the corresponding gripping element 3.

Subsequently, the rotation of the gripping element 3 allows the piece 1 of filter material to be positioned in the operating station 4 (or the part of the piece 1 in question), so that the first operating station 4 can perform one or more operations on the piece 1.

Upon completion of the operations, the gripping element 3 rotates and moves away the piece 1 of filter material from the operating station 4, in such a way that, at an outfeed area of the movement carousel 2, the piece 1*a* is free to be transferred to a subsequent processing step/station, for example a second movement carousel, or suitably stored if the formation is completed.

This configuration allows an intermediate operation or the completion of the filter bag to be obtained on a large number of pieces of filter material per unit of time and in a reduced space (angular section).

It should be noted that the carousel 2 forms a circumferential surface parallel to the main axis X2 of rotation and on which are positioned the plurality of operating stations 4 and the corresponding plurality of gripping elements 3.

In light of this, each operating station 4 is positioned fixed on a first part of a circumferential surface 2*a* formed by the movement carousel 2.

Each gripping element 3 is positioned along a second part of the circumferential surface 2*a* of the carousel 2 in such a way that it faces the corresponding operating station 4.

In the case illustrated, the operating station 4 is away from the outer edge formed by the circumferential surface 2*a* of the carousel 2, whilst the gripping elements 3 are moved towards the outer edge formed by the circumferential surface 2*a* of the carousel 2.

In the case illustrated, by way of a non-limiting example, each operating station 4 is a station for applying the string 1*g* and a tag 1*t* on an end 1*a* of the piece 1 of filter material.

In this specific case, the piece 1 is picked up by the gripping elements 3 (again with continuous movement) from the wheel or conveying device 21 in such a way as to block a zone close to the head end 1*a* of the piece 1 where, in this specific case, there is the tag 1*t*. In this case, therefore, each gripping element 3 is configured for picking up and retaining the piece 1 and tag 1*t*, keeping the end part 1*a* of the piece 1 free for the operation for applying the string 1*g* on the piece 1 and on the tag 1*t* with relative joining of the tag to the piece 1 by the operating station 4.

In FIG. 1 (by way of non-limiting example), the conveying device 21 (comprising a carousel rotating continuously about an axis parallel to the main axis X2 of rotation) prepares and moves each piece 1 of filter material combined with a tag 1*t* located at the head end of the piece 1.

The individual tags 1*t* are fed from a rotary magazine 21*m* located in the proximity of the conveying device 21.

It should be noted that the conveying device 21 rotates in an anti-clockwise direction, whilst the carousel 2 rotates in a clockwise direction.

Below the carousel 2 is positioned a magazine 2*m* (reel) for feeding the string 1*g* towards a tangential zone of the carousel 2 in such a way that each operating station 4 intercepts and picks up, during its passage, a portion of string 1*g* to be applied to the piece 1 of filter material.

In this specification the operating station 4 is not described in detail, but only illustrated.

As illustrated in FIGS. 3 to 9, each gripping element 3 comprises a gripper 6 for gripping, retaining and releasing the piece 1 of filter material.

Each gripping element 3 also comprises the articulation means 5 connected to the gripper 6 to obtain a further rotation about the secondary axis X5 of rotation, transversal to the main axis X2 of rotation.

Figures 3, 3A:
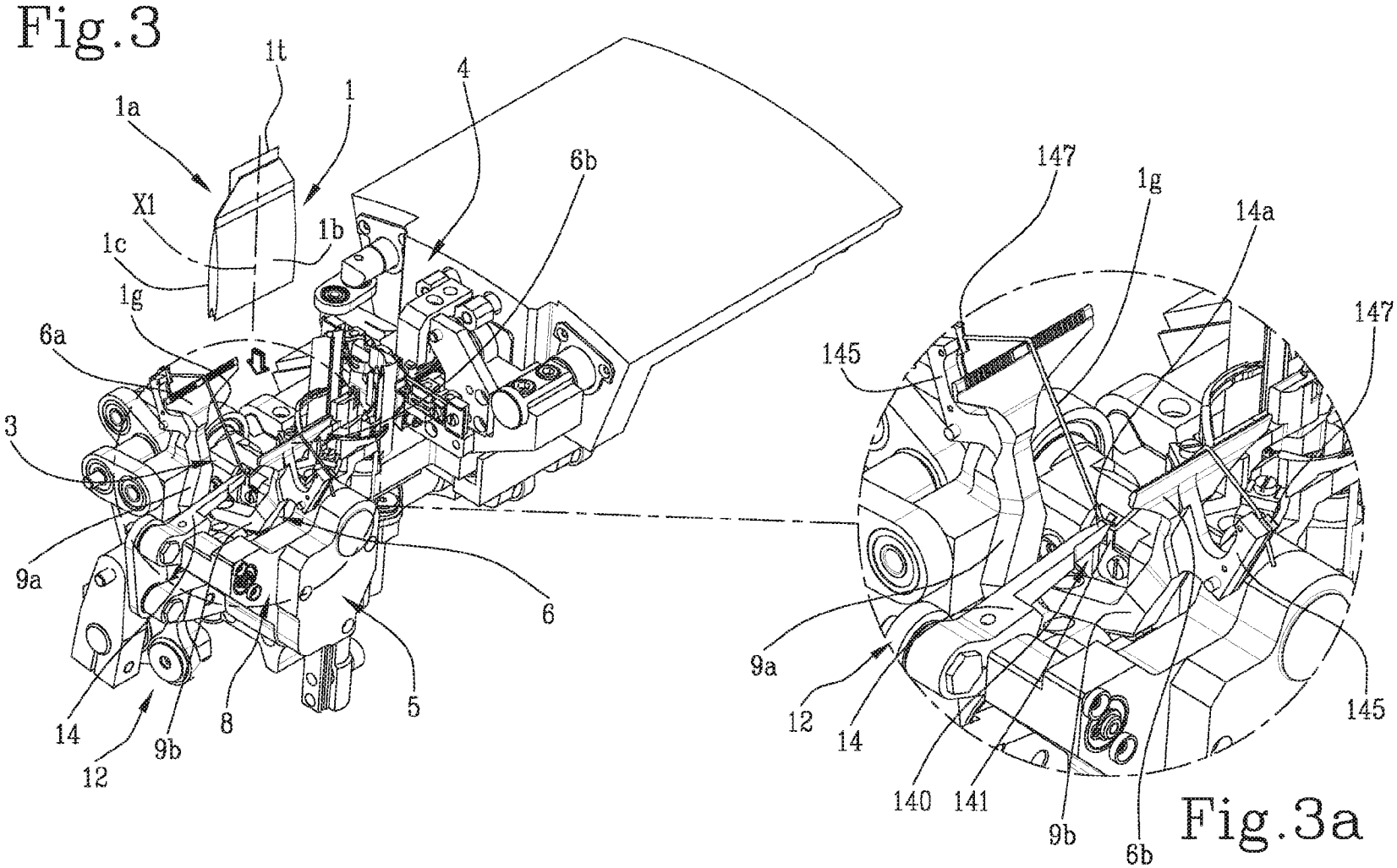
FIGS. 3 to 6 are perspective views, each illustrating one of a plurality of operational stations arranged on the carousel shown in FIG. 2 in corresponding different operating configurations for forming the filter bag.
FIG. 3*a* is an enlarged detail of FIG. 3.
Figure 4:
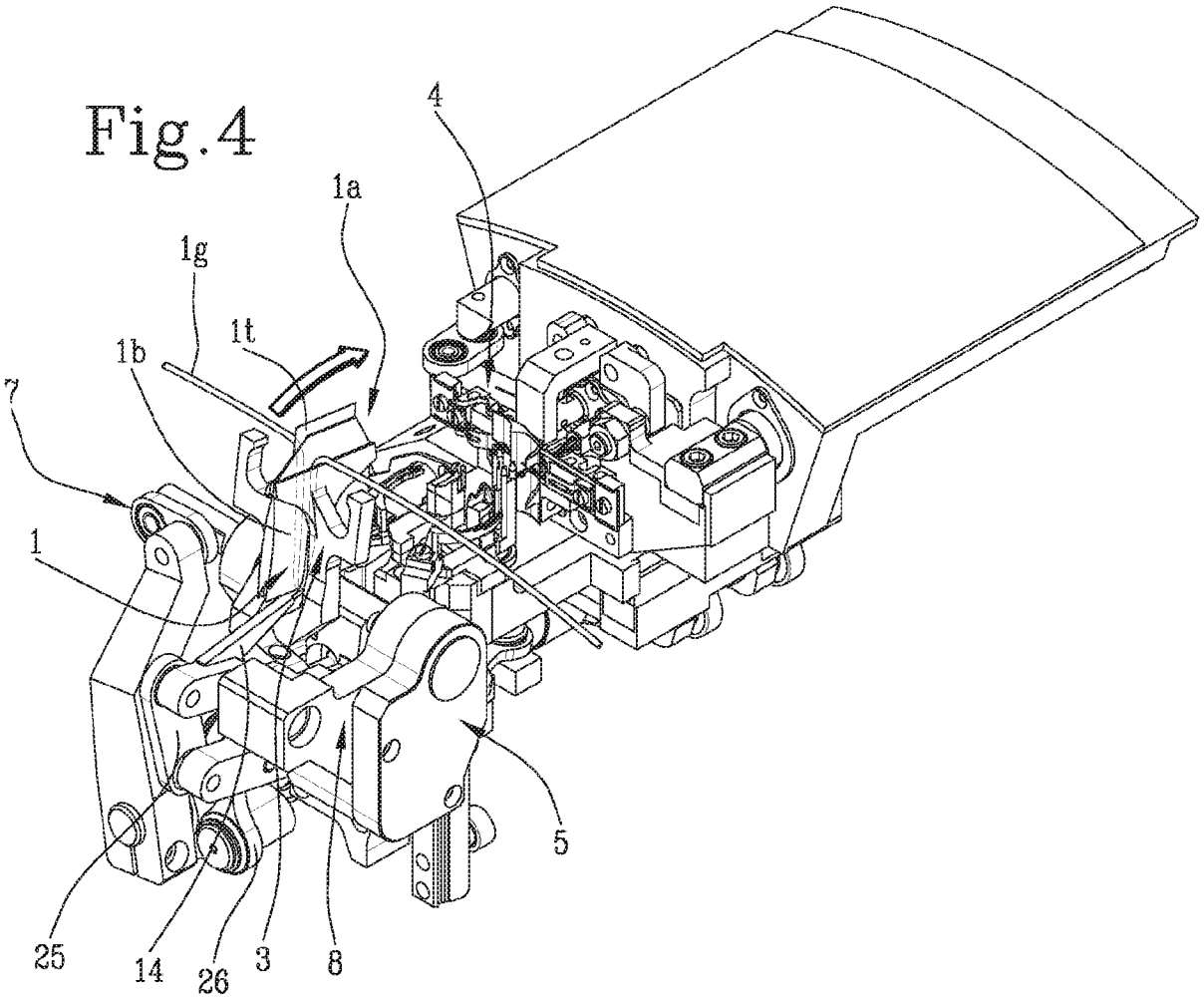

The gripping element 3 also comprises a movement device 7 connected to the gripper 6 for moving the gripper 6 between a first non-operating open position for receiving or release (FIG. 3) and a near operating position for retaining the piece 1 of filter material (FIG. 4).

It should be noted that each gripping element 3 comprises a tower 8 for supporting the gripper 6.

Preferably, the movement device 7 is connected to the gripper 6 along the above-mentioned secondary axis X5 of rotation, transversal to the main axis X2 of rotation.

The combined structure of the secondary rotation and opening and closing units of the gripper along the same axis X5 makes it possible to considerably reduce the dimensions of each gripping element.

Preferably, each gripper 6 comprises at least two plates 6*a*, 6*b* facing each other for gripping the piece 1 of filter material and a corresponding arm 9*a*, 9*b* for supporting each gripping plate 6*a*, 6*b*.

In light of this, each arm 9*a*, 9*b* is articulated on the supporting tower (8) and connected to the movement device 7 in such a way as to rotate the two plates 6*a*, 6*b* between the open, non-operating position (for receiving or release), with the plates 6*a*, 6*b* spaced apart, and the near operating position, with the plates 6*a*, 6*b* moved towards each other, for gripping the piece 1 of filter material.

Preferably, each articulation means 5 comprises (see FIG. 8) a gear wheel 10 keyed rotatably, by a first shaft 11 positioned coaxially to the secondary axis X5 of rotation, to the supporting tower 8.

Moreover, each articulation means 5 comprises a first motion transmission unit 12 connected by a kinematic mechanism between the gear wheel 10 and a first cam means 13 for controlling the rotation of the tower 8 and positioning the gripping element 3 and the corresponding piece 1 of filter material with its longitudinal axis X1 of extension from the position transversal to the main axis X2 of rotation to the position parallel to the main axis X2 of rotation at least at the operating station 4, and vice versa, along at least one stretch of the operating path P in the closed circular trajectory of the movement carousel 2.

In other words, the first cam means 13 are configured to rotate (by means of the first drive 12) the tower 8 towards the operating station 4 for a time/arc of rotation of the carousel 2 sufficient to complete the operation on the piece 1 of filter material and, subsequently, return the tower 8 to the initial position to allow the release of the piece 1 of filter material processed.

On the tower 8 are operatively positioned means 140 for temporarily retaining a tie string 1*g* for preparing a stretch of the tie string 1*g* inside the space formed by the plates 6*a* and 6*b* of the gripper 6 in the first open, non-operating position and awaiting the piece 1 of filter material.

These retaining means 140 comprise a movable reference element 14 and a flexible plate 141.

The movable reference element 14 is connected to the above-mentioned drive unit 12; the flexible plate 141 is associated with the tower 8 and extends transversally relative to the main axis X2 of rotation.

The reference element 14 (see in particular FIGS. 3, 3*a* and 4) is configured for positioning parallel to the main axis X2 of rotation and below the gripping element 3, in such a way as to retain a stretch of the string 1*g* on the bottom of the piece 1 of filter material in conjunction with the flexible plate 141 at the positioning of the piece 1 of filter material between the plates 6*a* and 6*b* of the gripper 6.

This reference element 14 comprises a rod having a contact head 14*a* with a projection of the flexible plate 141 to be able to ensure stable retaining of the stretch of string 1*g* in the lower zone of the space formed of the plates 6*a* and 6*b* of the gripper 6 and close to the tower 8.

The positioning/feeding of the string 1*g* is performed in a predetermined zone of the carousel 2 and at the passage of each gripper 6 in that zone.

More specifically, during the continuous rotation of the carousel 2, the string 1*g* (continuous) is fed to the carousel 2 in such a way as to position itself (taut and in a tangential position to the carousel 2) close to two plates 6*a* and 6*b* of the gripper 6 in passage (string 1*g* fed from the magazine 2*m*).

It should be noted (FIG. 10) that the continuous string 1*g* is guided by a tensioning drum 142 positioned next to the carousel 2.

The tensioning drum 142 is equipped, along its circumference, with a plurality of arc-shaped sectors 143 for guiding the continuous string 1*g* in order to keep the string taut 1*g*.

The tensioning drum 142 is also equipped with at least one insertion element 144 configured to intercept the continuous string 1*g* and insert the string 1*g* in the space between the two open plates 6*a* and 6*b* with subsequent positioning of the string 1*g* between the reference element 14 and the plate 141 (thanks to the flexibility of the plate).

Preferably, on the tensioning drum 142 there are two or more insertion elements 144, each positioned between two consecutive curved guide sectors 143.

It should be noted that each insertion element 144 comprises an arm 144*a* connected to cam means 148, positioned on the tensioning drum 142, for allowing a rectilinear movement in both directions, that is, radial relative to the tensioning drum 142, between a non-operating position, wherein the arm 144*a* is retracted, and a forward operating position, wherein the arm 144*a* is advanced beyond the overall dimensions of the tensioning drum 142 and intercepts the portion of continuous string 1*g* taut between the two plates 6*a* and 6*b*.

The arm 144*a* has its head end 144*b* configured in the form of a fork in such a way as to pull the continuous string 1*g* towards the retaining area formed by the reference element 14 and the flexible plate 141.

Figure 10:
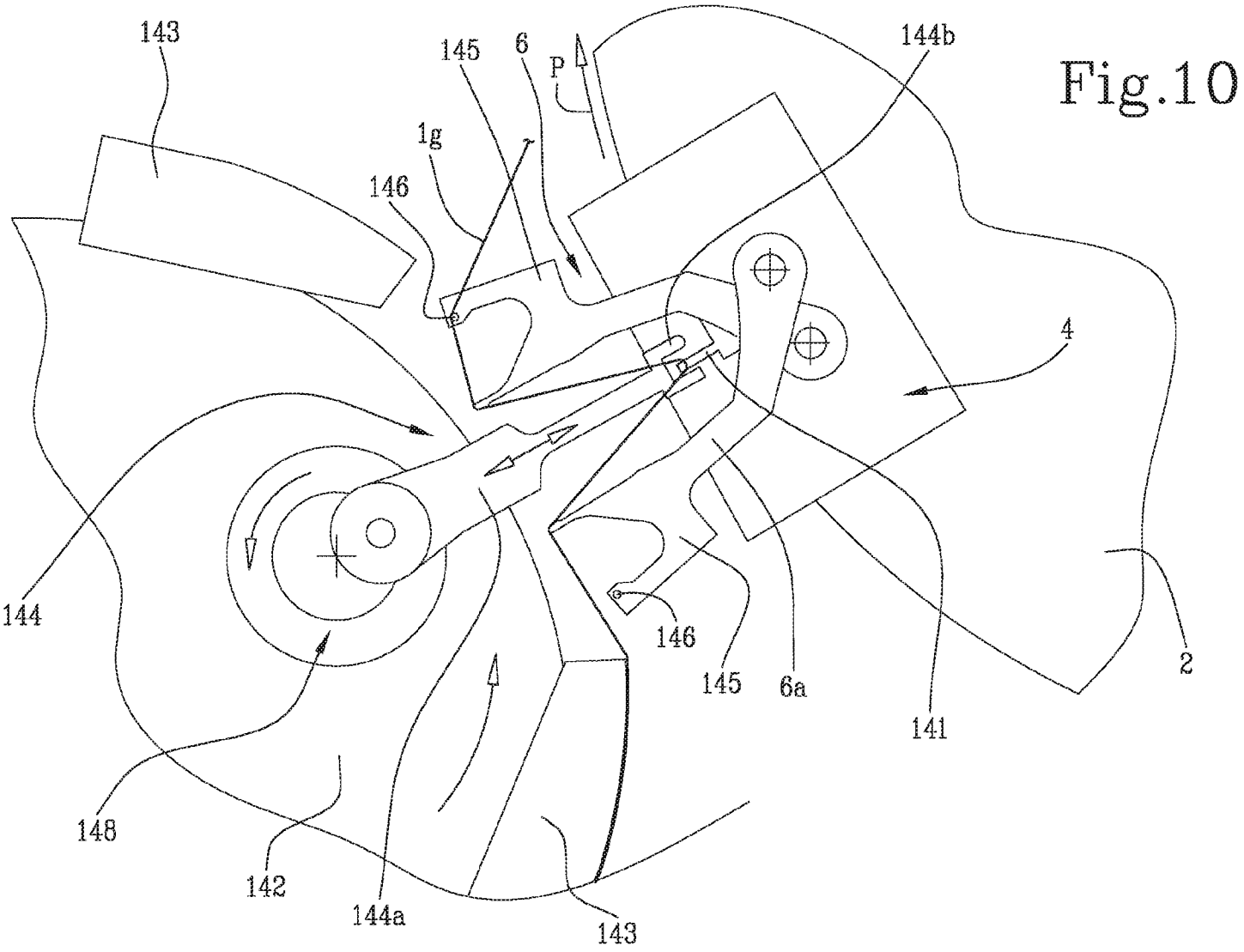
FIG. 10 illustrates a schematic front view, with some parts cut away to better illustrate others, of a part of the carousel of FIGS. 1 and 2 and a tensioning drum for feeding a continuous string to the carouse.

The head 144*b* of the arm 144*a* pushes the continuous string 1*g* in such a way as to bend the plate 141 and allow the entrance of the continuous string 1*g* between the plate 14 and the reference element 141 and remain there (see FIG. 10).

It should also be noted that each plate 6*a* and 6*b* of each gripper 6 is equipped with a tooth 145 protruding outside the plate 6*a* or 6*b* relative to the zone for housing the piece 1 of filter material.

Each tooth 145 has a pin 146 for centring and sliding of the continuous string 1*g* protected by a wall 147 in such a way as to define a channel for constraining the string 1*g*.

The string 1*g* being unwound is progressively intercepted by the pins 146 of the arms 6*b* and 6*a* (relative to the direction of rotation of the carousel 2 which in this case, only by way of example, is in a clockwise direction), and may be performed safely during the insertion of the stretch of string 1*g* inside the zone for housing by the arm 144*a*.

The string 1*g* therefore remains positioned in a "V"-shaped extension, inside the housing space defined by the two open plates 6*a* and 6*b* and constrained in three clearly defined points in such a way as to prevent movements of the portion of the string 1*g* until the closing of the gripper 6 on the piece 1 which determines the stabilisation of the piece 1 and the portion of string 1*g*.

It should be noted that the rod 14 has a raising/lowering movement, by a relative articulation to the drive unit 12, for correctly following the rotation of the piece 1 of filter material towards and away from the operating station 4.

The lifting of the rod 14 during the rotation of the tower 8 allows the releasing of the string 1*g*, which may thus come into contact with the bottom of the piece 1 of material before the knotting operations in the corresponding operating station 4.

Figure 8:
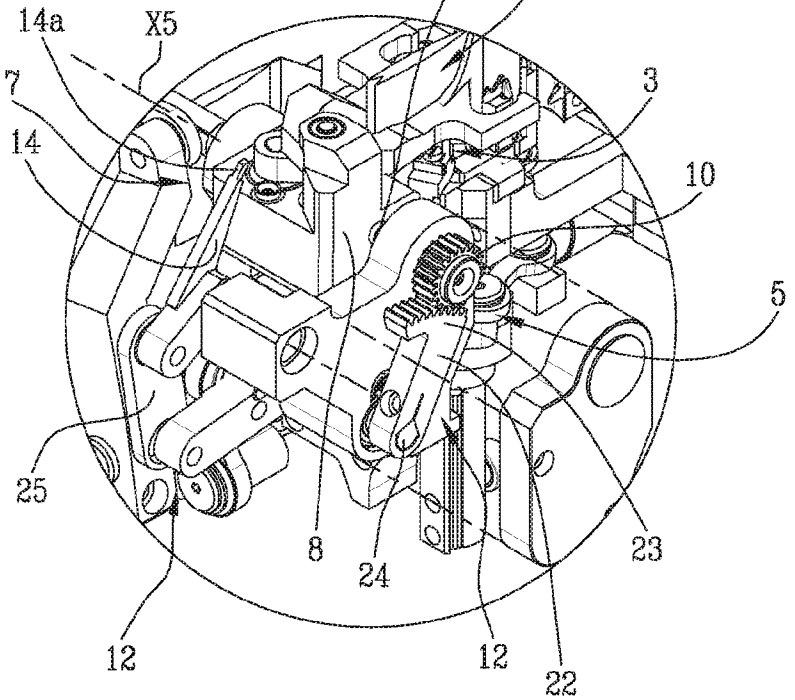
FIG. 8 illustrates an enlarged view of a part of the operating station and gripper elements referred to FIG. 5 and with some parts cut away to better illustrate others.
Figure 9:
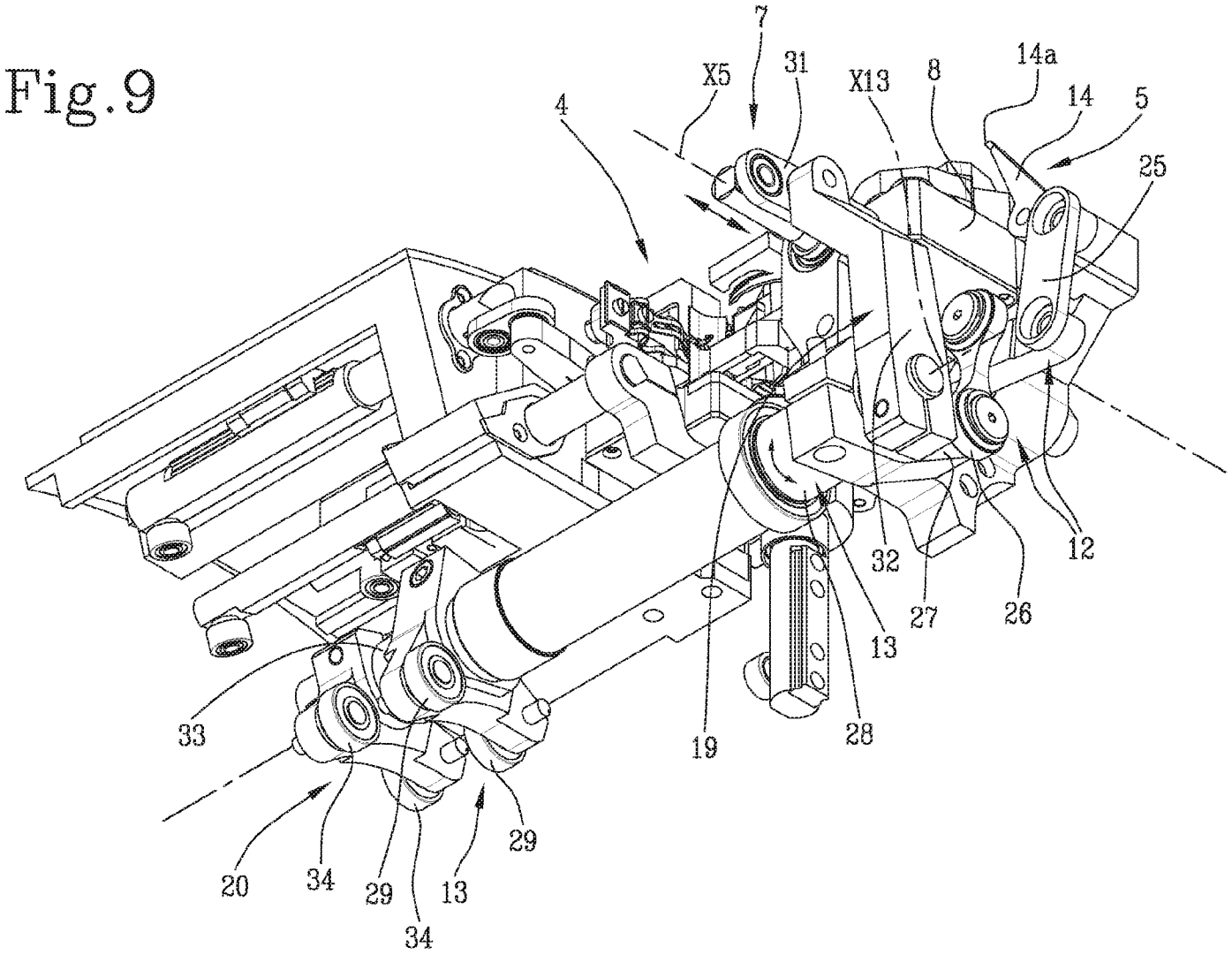
FIG. 9 is a perspective view from below of a single operating station of the carousel of FIG. 2.

As illustrated in FIGS. 8 and 9, the drive unit 12 comprises a lever 22 equipped, at a first end, with a toothed arc 23 meshed in the gear wheel 10.

The drive unit 12 also comprises a transmission shaft 24 positioned parallel to the secondary axis X5 of rotation. The transmission shaft 24 is keyed, at a relative end, to the second end of the lever 22.

The drive unit 12 comprises a four-bar linkage 25 positioned on a vertical plane transversal to the secondary axis X5 of rotation and on which is rotatably articulated, on its upper part, the reference element 14. The four-bar linkage 25 is connected at the free end of the transmission shaft 24.

The four-bar linkage 25 is connected to the first cam means 13 using a connecting rod 26 configured to obtain an angular drive of the lifting and lowering motion of the four-bar linkage 25.

The movement is in effect controlled by the first cam means 13 extending along an axis X13 parallel to the main axis X2 of rotation.

The connecting rod 26 is articulated, below, at the end of a first flange 27 connected to a proximal end of a first cylinder 28 rotatably mobile about the axis X13.

The first cylinder 28 is connected, at its distal end, with a pair of first cam follower rollers 29 positioned along a first circular cam track 30 positioned inside the carousel 2.

Figure 7:
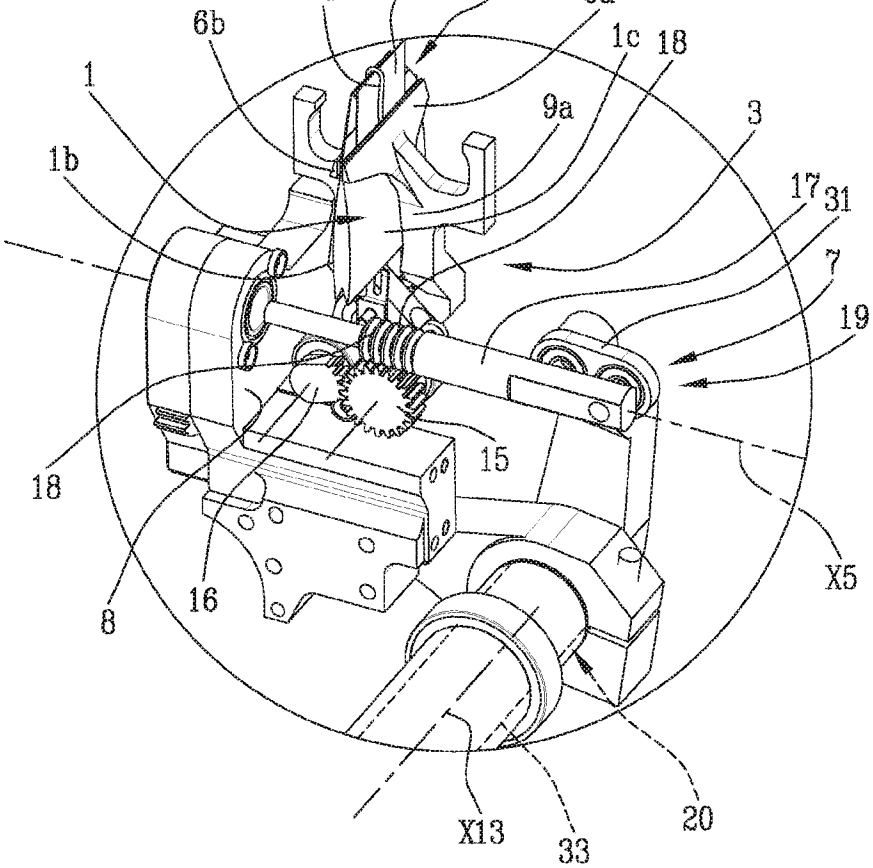
FIG. 7 illustrates an enlarged view of a part of the operating station and gripper elements referred to FIG. 4 and with some parts cut away to better illustrate others.

As illustrated in FIGS. 7 and 9, each movement device 7 comprises, inside the supporting tower 8:

- a main gear wheel 15 keyed to an arm, 9*a*, of the gripping element 3;
- a satellite gear wheel 16 keyed to the other arm 9*b* of the gripping element 3;
- a second shaft 17 positioned coaxially to the secondary axis X5 of rotation; the second shaft 17 is equipped, on a relative cylindrical portion, with a plurality of circular compartments formed from a corresponding series of annular slits 18 equidistant along the second shaft 17 and on which it is meshed on the main gear wheel 15 with the possibility of rotation about the secondary axis X5 of rotation;
- a second motion transmission unit 19 connected between the second shaft 17 and a second cam means 20 for controlling the translation, in both directions, of the second shaft 17 along the secondary axis X5 of rotation in such a way as to allow the rotation of the two plates 6*a* and 6*b* between the open, non-operating position, with the plates 6*a* and 6*b* spaced apart, and a near operating position, with the plates 6*a* and 6*b* moved towards each other, for gripping the piece 1 of filter material.

In other words, the second cam means 20 allow a translation of the second shaft 17 in both directions so as to act as a rack to obtain the rotation of the main gear wheel 15 (in one direction or the other) and consequently, the inverse rotation of the satellite gear wheel 16 so as to obtain the movement of the plates 6*a* and 6*b*.

The circular structure of the meshing incisions 18 allow the gripper 6 to rotate about the secondary axis X5 of articulation without thereby limiting the kinematic coupling between the main gear wheel 15 and the second shaft 17.

The second cam means 20 which allow the transfer of the second shaft 17 comprise a connecting rod 31 positioned parallel to the second shaft 17 and articulated at a free end of the second shaft 17.

The connecting rod 31 is articulated, in turn, to a second flange 32 connected to a proximal end of a second cylinder 33 (coaxial with and inside the first cylinder 28) and rotatably movable about the axis X13 parallel to the main axis X2 of rotation.

The second cylinder 33 is connected, at its distal end, with a pair of second cam follower rollers 34 positioned along a second circular cam track 35 positioned inside the carousel 2.

This invention provides a method for making filter bags for infusion products starting from pieces 1*a* of filter material each containing at least one dose of infusion product.

Each piece 1 of filter material has a corresponding longitudinal axis X1 of extension.

Figure 5:
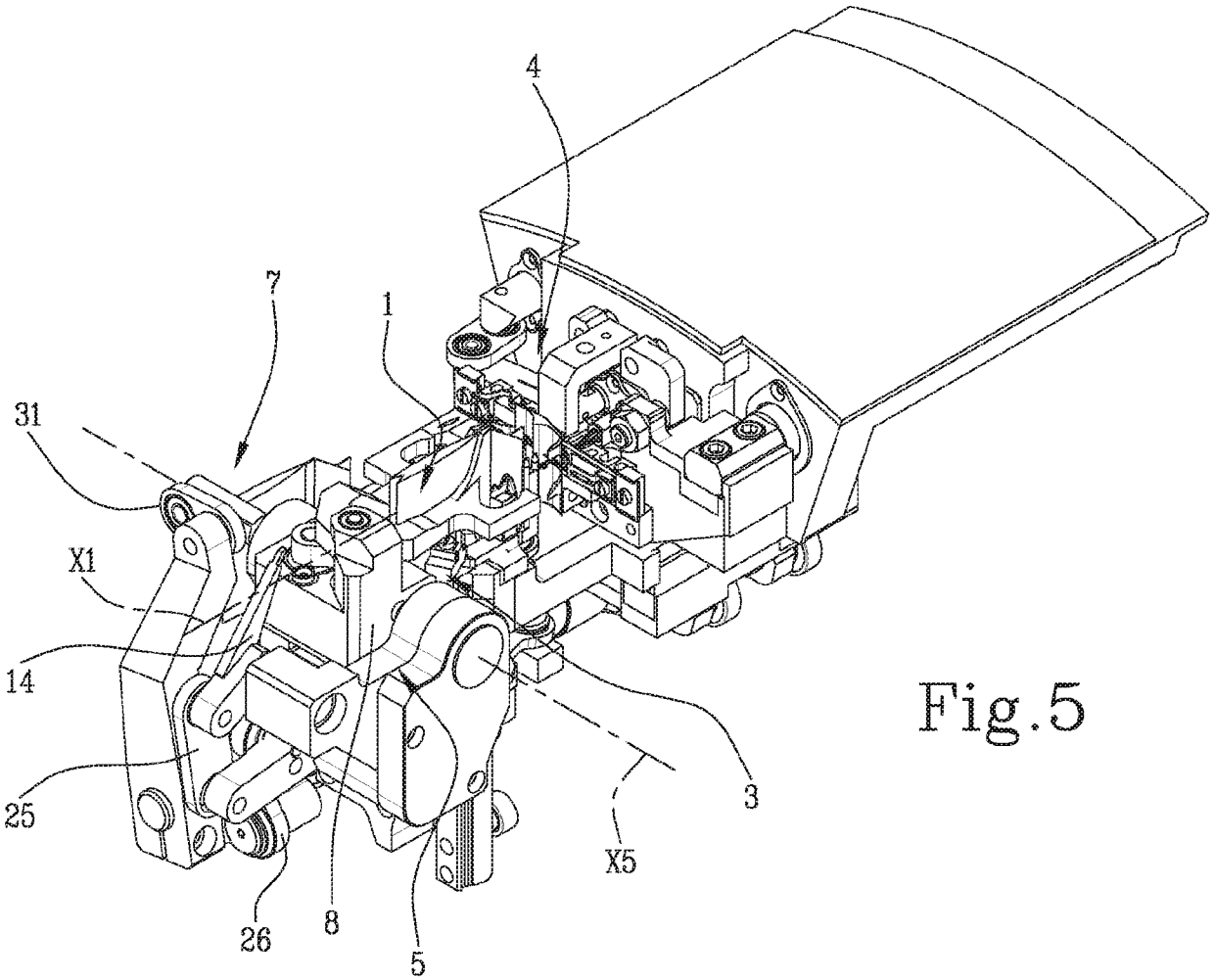

The method comprises at least the following steps:

feeding pieces 1 of filter material being formed to a movement carousel 2 having a plurality of elements 3 for gripping the pieces 1 of filter material; the carousel 2 rotating (continuously) about the main axis X2 of rotation (FIG. 3);

rotating the pieces 1 of filter material about the main axis X2 of rotation, positioned, with the relative longitudinal axis X1, transversal to the main axis X2 of rotation, and retained by corresponding gripping elements 3;

rotating further the pieces 1 of filter material about corresponding secondary axes X5 rotation, transversal to the main axis X2 of rotation (FIG. 4); and placing the pieces 1 of filter material with the corresponding longitudinal axis X5 of extension parallel to the main axis X2 of rotation at an operating station 4 configured to perform at least one operation on the piece 1 of filter material being formed, retained by a corresponding gripping element 3 (FIG. 5).

Figure 6:
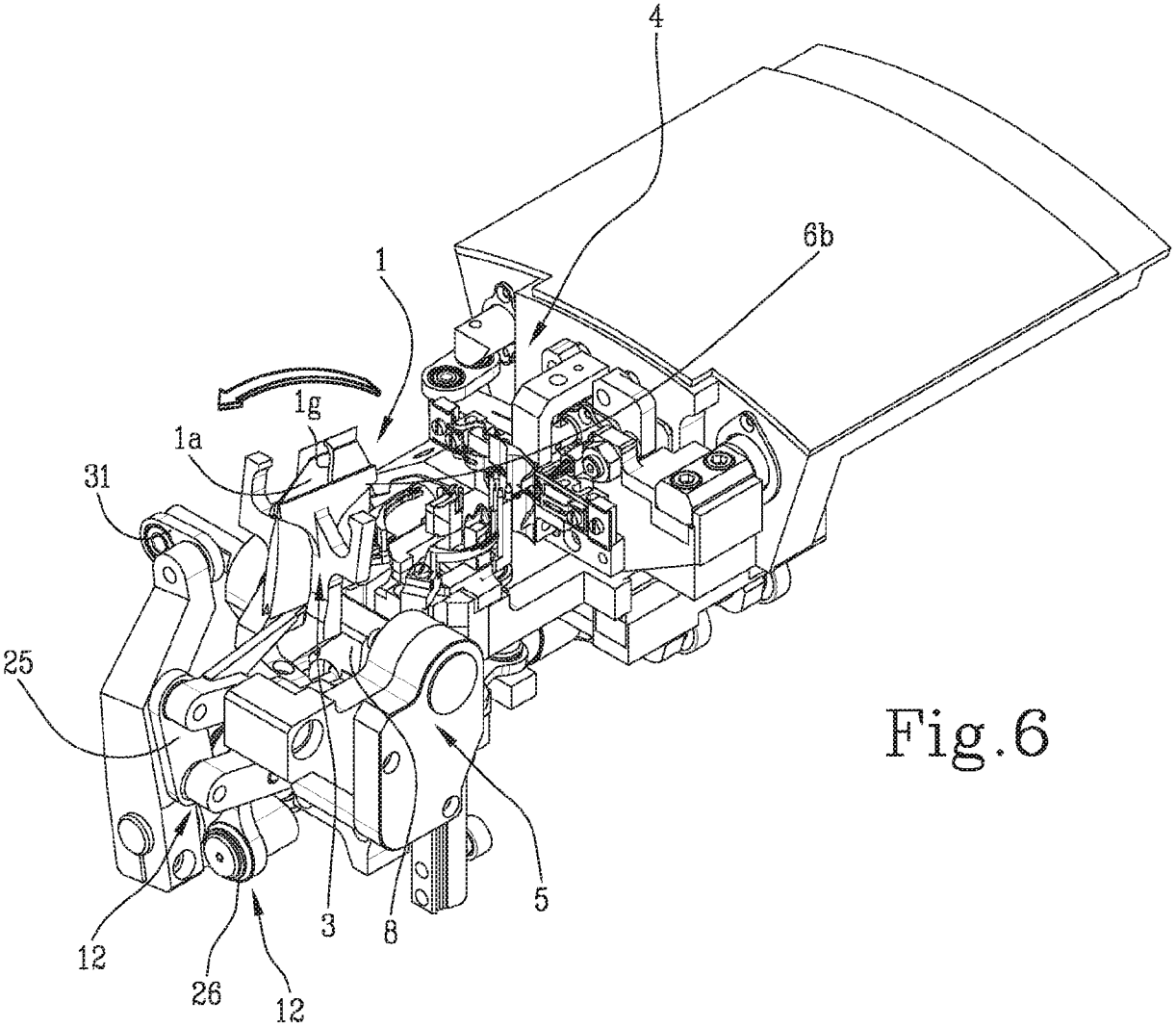

There is then a step of further rotation, the opposite direction to the previous rotation, about the secondary axis X5 rotation to return the piece 1 of filter material with its longitudinal axis X1 transversal to the main axis X2 of rotation, again held from the corresponding gripping element 3 (FIG. 6).

Then there is a further step of releasing the piece 1 of material from the corresponding gripping element 3.

The preset aims are fully achieved with the machine structure just described.

In effect, a machine according to the invention is extremely flexible and with a high productivity and with reduced dimensions.

The solution of foldable gripper elements can be used in different types of machines, both with continuous movement and with discontinuous or step-like movement.

Each unit may operate on the piece of filter material along an extremely short arcuate stretch of the carousel and, thanks to the particular gripping elements, may receive and release the piece quickly and with the possibility of starting the operations immediately, reducing the down times and the dimensions of the machine.

Thanks to the gripping element/operating station combination, the positioning of the piece of filter material in the station is rapid, precise and allows a high quality in a reduced unit of time.

The invention claimed is:

1. A machine for making filter bags for infusion products starting from pieces of filter material each containing at least one dose of infusion product and having a corresponding longitudinal axis of extension, the machine comprising:

a carousel rotatable about a main axis of rotation and including a plurality of movable gripping elements rotatable about the main axis of rotation along a closed circular trajectory, each gripping element being configured to receive and retain a piece of filter material along an operating path; and at least one operating station configured to perform at least one operation on the piece of filter material retained by a corresponding gripping element along the operating path inside the closed circular trajectory;

wherein each gripping element includes an articulation device configured to provide a further rotation about a secondary axis of rotation, transversal to the main axis of rotation, to rotate and position the piece of filter material with the longitudinal axis of extension parallel to the main axis of rotation at the at least one operating station;

wherein the carousel is configured to rotate continuously about the main axis of rotation;

wherein the plurality of movable gripping elements are positioned along, and movable continuously with, the carousel; and wherein the at least one operating station comprises a plurality of first operating stations positioned along, and movable continuously with, the carousel, each operating station being linked to a corresponding gripping element and being configured to perform at least one operation on the piece of filter material along at least one stretch of the operating path in the closed circular trajectory of the carousel.

2. The machine according to claim 1, wherein each operating station is fixed on a first part of a circumferential surface formed by the carousel parallel to the main axis of rotation, each gripping element being positioned along a second part of the circumferential surface of the carousel in such a way that the gripping element faces the corresponding operating station.

3. The machine according to claim 1, wherein each operating station is a station for applying a tie string and a tag to one end of the piece of filter material.

4. The machine according to claim 1, wherein each gripping element comprises:

a gripper for gripping, retaining, and releasing the piece of filter material, wherein the articulation device is connected to the gripper to obtain the further rotation about the secondary axis of rotation, transversal to the main axis of rotation; and a movement device connected to the gripper for moving the gripper between a first non-operating open position for receiving or releasing the piece of filter material and a second near operating position for retaining the piece of filter material.

5. The machine according to claim 4, wherein each gripping element comprises a tower for supporting the gripper.

6. The machine according to claim 4, wherein the movement device is connected to the gripper along the secondary axis of rotation, transversal to the main axis of rotation.

7. The machine according to claim 5, wherein each gripper comprises at least two plates facing each other for gripping the piece of filter material and a corresponding arm for supporting each plate, each arm being articulated on the tower and connected to the movement device in such a way as to rotate the at least two plates between the first non-operating open position, with the plates spaced apart, and the second near operating position, with the plates moved towards one another, for gripping the piece of filter material.

8. The machine according to claim 7, wherein each articulation device comprises:

a gear wheel keyed rotatably, by a first shaft positioned coaxially with the secondary axis of rotation, to the tower; and a first motion transmission unit connected by a kinematic mechanism between the gear wheel and a first cam device for controlling rotation of the tower and moving the gripping element and the corresponding piece of filter material with the longitudinal axis of extension from a position transversal to the main axis of rotation to a position parallel to the main axis of rotation at the at least one operating station, and vice versa, along at least one stretch of the operating path in the closed circular trajectory of the carousel.

9. The machine according to claim 7, wherein on each tower is operatively positioned a retainer for temporarily retaining a tie string for preparing a stretch of the tie string inside a space formed by the plates of the gripper in the first non-operating open position.

10. The machine according to claim 8, wherein each movement device comprises, inside the tower:

a main gear wheel keyed to a first arm of the gripping element;

a satellite gear wheel keyed to a second arm of the gripping element;

a second shaft positioned coaxially with the secondary axis of rotation, the second shaft being equipped, on a cylindrical portion, with a plurality of circular compartments formed from a corresponding series of annular slits equidistantly positioned along the second shaft, the second shaft being meshed to the main gear wheel and being rotatable about the secondary axis of rotation; and a second motion transmission unit connected between the second shaft and a second cam device for controlling translation, in both directions, of the second shaft along the secondary axis of rotation in such a way as to allow the rotation of the at least two plates between the first non-operating open position, with the plates spaced apart, and the second near operating position, with the plates moved towards one another, for gripping the piece of filter material.

11. A machine for making filter bags for infusion products starting from pieces of filter material each containing at least one dose of infusion product and having a corresponding longitudinal axis of extension, the machine comprising:

a carousel rotatable about a main axis of rotation and including a plurality of movable gripping elements rotatable about the main axis of rotation along a closed circular trajectory, each gripping element being configured to receive and retain a piece of filter material along an operating path; and at least one operating station configured to perform at least one operation on the piece of filter material retained by a corresponding gripping element along the operating path inside the closed circular trajectory;

wherein each gripping element includes an articulation device configured to provide a further rotation about a secondary axis of rotation, transversal to the main axis of rotation, to rotate and position the piece of filter material with the longitudinal axis of extension parallel to the main axis of rotation at the at least one operating station; and wherein each operating station is fixed on a first part of a circumferential surface formed by the carousel parallel to the main axis of rotation, each gripping element being positioned along a second part of the circumferential surface of the carousel in such a way that the gripping element faces the corresponding operating station.

12. The machine according to claim 11, wherein each gripping element comprises:

a gripper for gripping, retaining, and releasing the piece of filter material, wherein the articulation device is connected to the gripper to obtain the further rotation about the secondary axis of rotation, transversal to the main axis of rotation; and a movement device connected to the gripper for moving the gripper between a first non-operating open position for receiving or releasing the piece of filter material and a second near operating position for retaining the piece of filter material.

13. The machine according to claim 12, wherein each gripping element comprises a tower for supporting the gripper.

14. The machine according to claim 13, wherein each gripper comprises at least two plates facing each other for gripping the piece of filter material and a corresponding arm for supporting each plate, each arm being articulated on the tower and connected to the movement device in such a way as to rotate the at least two plates between the first non-operating open position, with the plates spaced apart, and the second near operating position, with the plates moved towards one another, for gripping the piece of filter material.

15. The machine according to claim 14, wherein each articulation device comprises:

a gear wheel keyed rotatably, by a first shaft positioned coaxially with the secondary axis of rotation, to the tower; and a first motion transmission unit connected by a kinematic mechanism between the gear wheel and a first cam device for controlling rotation of the tower and moving the gripping element and the corresponding piece of filter material with the longitudinal axis of extension from a position transversal to the main axis of rotation to a position parallel to the main axis of rotation at the at least one operating station, and vice versa, along at least one stretch of the operating path in the closed circular trajectory of the carousel.

16. A machine for making filter bags for infusion products starting from pieces of filter material each containing at least one dose of infusion product and having a corresponding longitudinal axis of extension, the machine comprising:

a carousel rotatable about a main axis of rotation and including a plurality of movable gripping elements rotatable about the main axis of rotation along a closed circular trajectory, each gripping element being configured to receive and retain a piece of filter material along an operating path; and at least one operating station configured to perform at least one operation on the piece of filter material retained by a corresponding gripping element along the operating path inside the closed circular trajectory;

wherein each gripping element includes an articulation device configured to provide a further rotation about a secondary axis of rotation, transversal to the main axis of rotation, to rotate and position the piece of filter material with the longitudinal axis of extension parallel to the main axis of rotation at the at least one operating station; and wherein each operating station is a station for applying a tie string and a tag to one end of the piece of filter material.

17. The machine according to claim 16, wherein each gripping element comprises:

a gripper for gripping, retaining, and releasing the piece of filter material, wherein the articulation device is connected to the gripper to obtain the further rotation about the secondary axis of rotation, transversal to the main axis of rotation; and a movement device connected to the gripper for moving the gripper between a first non-operating open position for receiving or releasing the piece of filter material and a second near operating position for retaining the piece of filter material.

18. The machine according to claim 17, wherein each gripping element comprises a tower for supporting the gripper.

19. The machine according to claim 18, wherein each gripper comprises at least two plates facing each other for gripping the piece of filter material and a corresponding arm for supporting each plate, each arm being articulated on the tower and connected to the movement device in such a way as to rotate the at least two plates between the first non-operating open position, with the plates spaced apart, and the second near operating position, with the plates moved towards one another, for gripping the piece of filter material.

20. The machine according to claim 19, wherein each articulation device comprises:

a gear wheel keyed rotatably, by a first shaft positioned coaxially with the secondary axis of rotation, to the tower; and a first motion transmission unit connected by a kinematic mechanism between the gear wheel and a first cam device for controlling rotation of the tower and moving the gripping element and the corresponding piece of filter material with the longitudinal axis of extension from a position transversal to the main axis of rotation to a position parallel to the main axis of rotation at the at least one operating station, and vice versa, along at least one stretch of the operating path in the closed circular trajectory of the carousel.

* * * * *